US007832600B2

(12) United States Patent
Lindsay

(10) Patent No.: US 7,832,600 B2
(45) Date of Patent: Nov. 16, 2010

(54) TWIST TOPS

(75) Inventor: Brendan Jon Lindsay, Auckland (NZ)

(73) Assignee: Sistema Plastics Limited, Auckland (NZ)

( * ) Notice: Subject to any disclaimer, the term of this patent is extended or adjusted under 35 U.S.C. 154(b) by 0 days.

(21) Appl. No.: 12/230,894

(22) Filed: Sep. 8, 2008

(65) Prior Publication Data

US 2009/0071962 A1 Mar. 19, 2009

Related U.S. Application Data

(63) Continuation of application No. 11/071,592, filed on Mar. 4, 2005, now Pat. No. 7,677,421.

(51) Int. Cl.
*B67D 3/00* (2006.01)
*B67D 7/06* (2006.01)

(52) U.S. Cl. ..... 222/521; 222/507; 222/525

(58) Field of Classification Search ..... 222/519, 222/521, 523, 524, 525, 548, 549, 522, 507, 222/509, 505

See application file for complete search history.

(56) References Cited

U.S. PATENT DOCUMENTS 4,927,065 A * 5/1990 Beck ..... 222/520
5,004,127 A 4/1991 Morel ..... 222/521
5,111,977 A 5/1992 Maguire ..... 222/521
5,135,140 A 8/1992 Maguire ..... 222/521
5,947,331 A * 9/1999 Goncalves ..... 222/39
6,299,038 B1 10/2001 Schmeisser ..... 222/521

* cited by examiner

*Primary Examiner*—Kevin P Shaver
*Assistant Examiner*—Stephanie E Williams
(74) *Attorney, Agent, or Firm*—Jacobson Holman PLLC

(57) ABSTRACT

In another aspect the invention is a (drink bottle or container) closure assembly as a unit having an occlusion region providing first component, the first component being adapted for a closing engagement with a complementary bottle or container, and having a liquid passageway to be open from the bottle or container to an outlet below at least part of the occlusion region, as a second component, a spout or top with a dispensing outlet capable of being occluded by the occlusion region to provide a substantially liquid tight-environment from an engaged liquid bearing bottle or container unless the second component rises from its dispensing outlet occluding condition, and a third component, rotation of which controls the rise and fall of the second component relative to the occlusion region.

5 Claims, 26 Drawing Sheets

TWIST TOPS

CROSS-RELATED APPLICATIONS

This application is a Continuation of application Ser. No. 11/071,592 filed Mar. 4, 2005, now U.S. Pat. No. 7,677,421, which is incorporated hereby in reference.

TECHNICAL FIELD

The present invention relates to dispensing closure assemblies and related combinations, components, methods and uses.

BACKGROUND

Drink bottles frequently have a pull out member of a closure assembly which separates components so as to allow a dispensing pathway for liquid from within a drink container to which the closure assembly has been fixed.

Many of such forms of assembly require a pulling out of a member.

The present invention envisages a dispensing closure assembly where a simple twisting of part of the assembly will open the dispensing pathway. It is an alternative or a further object of the present invention to provide such a dispensing closure assembly where a simple twisting closes such a dispensing pathway.

DESCRIPTION OF THE INVENTION

The present invention is directed to any aspect of such closures.

In another aspect the invention is a dispensing closure assembly suitable to be engaged to a complementary container, said assembly comprising or including a first moulded component ("first component") adapted to engage an outlet of a complementary container and to provide an outlet from which any liquid content of such a container can egress, the moulded component including a closure portion above said outlet, a second moulded component ("second component") about part of said first component and having a dispensing outlet capable of being closed by the closure portion of said first component, a third moulded component ("third component") held captive by said first component but rotatable relative thereto, the assembly being characterised in that rotation of said third component relative to said first component (A) can cause movement of second component relative to said first component to effect opening (i.e. displacement of the closure portion from the dispensing outlet of the second component, or vice versa) and/or (B) can cause movement of said second component relative to said first component to effect closure (i.e. of the dispensing opening with said closure portion).

Optionally rotation one way achieves (A) and, optionally, rotation the other way achieves (B).

In another aspect the invention is a dispensing closure assembly suitable to be engaged to a complementary container, said assembly comprising or including a first component or assembly ("first component") adapted to engage an outlet of a complementary container and to provide an outlet from which any liquid content of such a container can egress, the moulded component including a closure portion, a second component or assembly ("second component") about part of said first component and having a dispensing outlet capable of being both occluded to closure and not occluded to closure by the closure portion of said first component, a third component or assembly ("third component") held captive by said first component but rotatable relative thereto, the assembly being characterised in that rotation of said third component relative to said first component (A) can cause movement of second component relative to said first component to effect opening and/or (B) can cause movement of said second component relative to said first component to effect closure.

Optionally rotation one way achieves (A) and, optionally, rotation the other way achieves (B).

Preferably the first component outlet is of a passageway defining columnar form and preferably the closure portion is above the columnar outlet.

Preferably the third component fully surrounds at least part of the first component and at least part of the second component.

In one aspect the third component is adapted to rotate with it, in at least one direction, said second component and said second component, by bearing on said first component, is as a consequence displaced axially of such rotational movement relative to the first component.

Preferably the axial displacement is under the action of a thread or the equivalent interengagement between said second component and said first component, e.g. as hereinafter disclosed.

In another aspect the invention is a dispensing closure assembly suitable to be engaged to a complementary container, said assembly comprising or including a first moulded component ("first component") adapted to engage an outlet of a complementary container and to provide an outlet from which any liquid content of such a container can egress, the moulded component including a closure portion above said outlet, a second moulded component ("second component") about part of said first component and having a dispensing outlet capable of being closed by the closure portion of said first component, said second component being threadedly associated with the first component so that rotation of one relative to the other can cause closure and/or opening by axial movement of the dispensing outlet relative to the closure portion.

a third moulded component ("third component") held captive by said first component but rotatable relative thereto, and able to rotate the second component coaxially therewith.

In another aspect the invention is a dispensing closure assembly suitable to be engaged to a complementary container, said assembly comprising or including a first component or assembly ("first component") adapted to engage an outlet of a complementary container and to provide an outlet from which any liquid content of such a container can egress, the component including a closure portion, a second component or assembly ("second component") about part of said first component and having a dispensing outlet capable of being closed by the closure portion of said first component, said second component being threadedly associated with the first component so that rotation of one relative to the other can cause closure (e.g occlusive closure) and/or opening by axial movement of the dispensing outlet relative to the closure portion.

a third component or assembly ("third component") held captive by said first component but rotatable relative thereto, and able to rotate the second component coaxially therewith.

Preferably at least one, two or all three of the components is a moulded non fabricated member.

Preferably the first component outlet is of a passageway defining columnar form and preferably the closure portion is above the columnar outlet.

Preferably the first component defines an internally threaded region adapted to engage the complementary thread of a complementary container.

Preferably said internally threaded region is integral with a region defining an annular space the inner boundary of which is form defining a passageway with an inlet and leading to an outlet, said outlet being below said closure portion.

Preferably the passageway and/or boundary and/or closure portion is coaxial with the internal thread rotational axis.

Preferably said inner boundary form has externally thereof a thread or thread follower.

Preferably said second component is a member having a guide-way, or a guide-way follower, to provide a non rotational guided sliding relationship with a guide-way follower, or guide-way, of and relative to said third component.

Preferably the second component has an internal thread follower or thread to engage its complement thread or thread follower of the inner boundary form.

In yet another aspect the invention is a dispensing closure assembly suitable to be engaged to a complementary container, said assembly comprising or including a first moulded component ("first component") adapted to engage an outlet of a complementary container and to provide an outlet from which any liquid content of such a container can egress, the moulded component including a closure portion above said outlet, a second moulded component ("second component") about part of said first component and having a dispensing outlet capable of being closed by the closure portion of said first component, the first and second components coacting to restrict their relative movement at least substantially to a rectilinear or at least substantially non rotational movement of one relative the other, a third moulded component ("third component") held captive by said first component but rotatable relative thereto, and being threadedly associated with the second component so that relation of the third component can cause closure and/or opening by axial movement of the dispensing outlet relative to the closure portion.

In yet another aspect the invention is a dispensing closure assembly suitable to be engaged to a complementary container, said assembly comprising or including a first component or assembly ("first component") adapted to engage an outlet of a complementary container and to provide an outlet from which any liquid content of such a container can egress, the moulded component including a closure portion, a second component or assembly ("second component") about part of said first component and having a dispensing outlet capable of being closed by the closure portion of said first component, the first and second components coacting to restrict their relative movement in favour of movement required to effect closure and/or opening, a third component or assembly ("third component") held captive by said first component but rotatable relative thereto, and being threadedly associated with the second component so that relation of the third component can cause closure and/or opening by axial movement of the dispensing outlet relative to the closure portion.

Preferably at least one, two or all three of the components is a moulded non fabricated member.

Preferably the first component defines an internally threaded region adapted to engage the complementary thread of a complementary container.

Preferably said internally threaded region is integral with a region defining a passageway and/or closure portion.

Preferably the second component has an external thread or thread followers to complement an internal thread or thread follower of said third component.

Preferably the second component is engageable into the first component so as not to rotate relative thereto but to rise and/or fall depending on its threaded relationship with the third component as it is rotated one way or the other.

In another aspect the invention is a (drink bottle or container) closure assembly as a unit having an occlusion region providing first component, the first component being adapted for a closing engagement with a complementary bottle or container, and having a liquid passageway to be open from the bottle or container to an outlet below at least part of the occlusion region, as a second component, a spout or top with a dispensing outlet capable of being occluded by the occlusion region to provide a substantially liquid tight environment from an engaged liquid bearing bottle or container unless the second component rises from its dispensing outlet occluding condition, and a third component, rotation of which controls the rise and fall of the second component relative to said occlusion region.

In another aspect the invention is, in combination, a dispensing closure assembly as aforesaid [in any of its aspects or preferments] and a complementary container.

Preferably the first component screw engages the container.

The combination is capable of being sold empty (e.g as a fillable drink bottle) or filled (preferably with a foil or other seal under the closure assembly).

Preferably the dispensing closure assembly can be screw disengaged or screw engaged on said container when one of the following occurs, (i) there is movement of the components first to a fully closed condition, (ii) there is movement of the components first to a fully open condition, and/or (iii) the first component provides sufficient purchase for its rotation relative to the container.

Preferably, where (i), (ii) or (iii), there is rotation in synchrony of all three components during the screw disengagement or screw engagement.

In another aspect the invention is a drink container with a dispensing pathway closure assembly with a twist open capability preferably reliant on an assembly as aforesaid.

In another aspect the invention is any one or more of a first, second and/or third component as previously defined and/or substantially as hereinafter described with reference to part or all of any one or more of the accompanying drawings.

As used herein the term "and/or" refers to "and" or "or".

As used herein "(s)" following a noun means the plural and singular form of that noun.

As used herein "above" with respect to said closure portion relative to said dispensing outlet of said first component is with respect to its level when notionally on an upright container with a first component engageable upwardly directed (preferably externally threaded) mouthed neck and/or head. Similarly "rise" and "fall".

As used herein "at least substantially to a rectilinear or at least substantially non rotational movement of one relative the other" preferably means movement solely axially of the rotational axis of said third component but less preferably can involve a slightly angled, helical or the like locus with very much less rotation than of the third component.

As used herein "thread" or "thread follower" includes any such twist to provide axial relative movement interrelationship formation, groove, etc (skeletal or not). It can be of a constant or varying pitch.

As used herein "close" or variants of close includes "occlude" and variants thereof.

As used herein "columnar" includes any upstand.

In still a further aspect the invention consists in the use of an assembly or apparatus of the present invention.

In still a further aspect the present invention consists in a dispensing pathway closure assembly substantially as hereinafter described with reference to any one or more of the accompanying drawings.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

A preferred form of the present invention will now be described with reference to the accompanying drawings in which FIG. 2 is a perspective view from below of the assembly as shown in FIG. 1, FIG. 3 is a plan view of the assembly of FIGS. 1 and 2, FIG. 4 is a view from below of the assembly of FIGS. 1 to 3, FIG. 5 is a side elevational view of the assembly of FIGS. 1 to 4 in the condition shown, FIG. 6 is a similar view to that of FIG. 5 but rotated by 90° and having the product in its open condition as a result of rotation (i.e twisting) of the third member, FIG. 7 is a section at AA of FIG. 5, FIG. 8 is a section at BB of FIG. 6 showing the closure portion which in FIG. 7 occludes the outlet of the second member (or top) clear of the opening and thus in a non occluding condition, FIG. 9 is a perspective view of the first component of the assembly of FIGS. 1 to 8, such component (the base) being shown in perspective from above, FIG. 10 is a similar view to that of FIG. 9 but rotating by 90°, FIG. 11 is a side elevational view of the first component of FIGS. 9 and 10, FIG. 12 is another side elevational view but rotated 90° from the condition shown in FIG. 11, FIG. 13 is a top view of the component of FIGS. 9 to 12, FIG. 14 is a bottom view of the component of FIGS. 9 to 13, FIG. 15 is a perspective view from below of the component of FIGS. 9 to 14, FIG. 16 is a cross section of the component of FIGS. 9 to 15 taken at CC as shown in FIG. 12, FIG. 17 is a perspective view from above of the preferred second component or top of the embodiment of FIGS. 1 to 16, FIG. 18 is a perspective view from below of the component of FIG. 17, FIG. 19 is a side elevational view of the component of FIGS. 17 and 18, FIG. 20 is another side elevational view of the component of FIGS. 17 to 19 but rotated by 90°, FIG. 21 is a bottom plan view of the component of FIGS. 17 to 20, FIG. 22 is a top plan view of the component of FIGS. 17 to 21, FIG. 23 is a cross section at DD of the component of FIGS. 17 to 22 as shown in FIG. 20, FIG. 24 is a perspective view from above of the third component of an assembly of the embodiment shown in FIGS. 1 to 23, the view being from above, FIG. 25 is a perspective view of the component of FIG. 24 from below, FIG. 26 is a similar view to that of FIG. 25 but upon rotation, FIG. 27 is a plan view of the component of FIGS. 24 to 26, FIG. 28 is a bottom view of the component of FIGS. 24 to 26, FIG. 29 is a side elevational view of the component of FIGS. 24 to 28, FIG. 30 is another side elevational view of the component of FIGS. 24 to 29 but rotated 90° with respect to what has been shown in FIG. 29, FIG. 31 is a section taken of the component of FIGS. 24 to 30 at EE as shown in FIG. 27, the cross section being in elevation, FIGS. 32 to 60 show a second preferred form of the present invention, FIG. 32 is a perspective view of a second embodiment of the present invention showing the device from above when in an open condition i.e not being occluded by the second component and its closure portion, FIG. 33 is a perspective view from below of the assembly as shown in FIG. 32, FIG. 34 shows the assembly of FIGS. 32 and 33 in its closed condition i.e with the closure portion of the second component occluding the outlet of the top or second component, FIG. 35 is a similar view to that of FIG. 34 but showing the assembly in its open dispensing condition (as in FIGS. 32 and 33), upon the rotation of the third component or twist component from the condition shown in FIG. 34 to the condition shown in FIG. 35, FIG. 36 is a plan view of the assembly of FIGS. 32 to 35, FIG. 37 is a bottom view of the assembly of FIGS. 32 to 36, FIG. 38 is a section at FF of the assembly in the condition as shown in FIG. 34, FIG. 39 is a cross sectional view of the assembly as shown in its condition of FIG. 35 at GG, FIG. 40 is a perspective view from above of the base or first component of the embodiment shown in FIGS. 32 to 39, FIG. 41 is a perspective view from below of the first component or base as shown in FIG. 40, FIG. 42 is a side elevational view of the component of FIGS. 40 and 41, FIG. 43 is a side elevational view of the component of FIG. 42 but upon rotation by 90°, FIG. 44 is a plan view from above of the component of FIGS. 40 to 43, FIG. 45 is a cross section at HH of the component of FIGS. 40 to 44 as shown in FIG. 43, FIG. 46 is a cross section of the component of FIGS. 40 to 45 at II as shown in FIG. 44, the thread of the columnar upstand or boundary form being shown, the outlet being below that part of the top most region which acts an occluding closure portion, FIG. 47 is a perspective view from below of a second component for the embodiment of FIGS. 32 to 46, there being a thread or thread follower segment internally thereof plus anti-rotational key ways, grooves or ribs axially or parallel to the axial direction, FIG. 48 is another perspective view of the component of FIG. 48 showing the dispensing outlet of such a top, FIG. 49 is a view from below of the component of FIGS. 47 and 48, FIG. 50 is a view from above of the component of FIGS. 47 to 49, FIG. 51 is a side elevational view of the component of FIGS. 47 to 50, FIG. 52 is another side elevational view of the component of FIGS. 47 to 50 but rotated by 90° with respect to the condition shown in FIG. 51, FIG. 53 is a section of the component of FIGS. 48 to 53 when taken at JJ as shown at FIG. 51, FIG. 54 is a perspective view from above of a third component (the twist ring collar) that coacts with the components of the assembly of FIGS. 32 to 53, FIG. 55 is a perspective view from below of the third component of FIG. 54, FIG. 56 is a side elevational view of the component of FIGS. 54 and 55, FIG. 57 is another side elevational view of the component of FIGS. 54 to 56 but this time rotated by 90°, FIG. 58 is a sectional view of the component of FIGS. 54 to 57 but taken at KK as shown in FIG. 57, FIG. 59 is a plan view from above of the component of FIGS. 54 to 58, FIG. 60 is a view from below of the component shown in FIGS. 54 to 59.

DETAILED DESCRIPTION OF THE INVENTION

Figure 1:
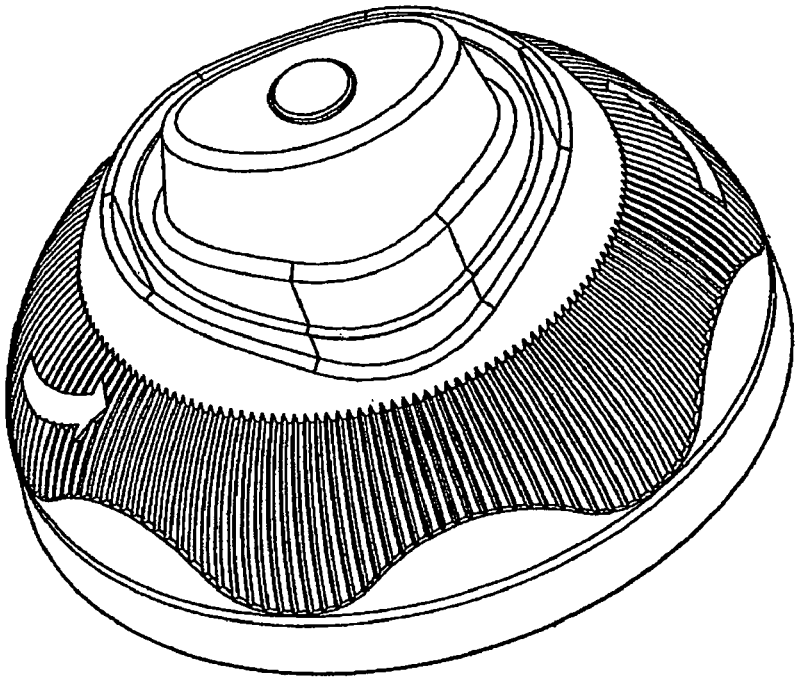
FIGS. 1 to 32 show a first preferred embodiment of the present invention, FIG. 1 showing a perspective view from above of a dispensing closure assembly of the present invention with the first member (the base) having its closure portion occluding the outlet of the second member.
Figure 2:
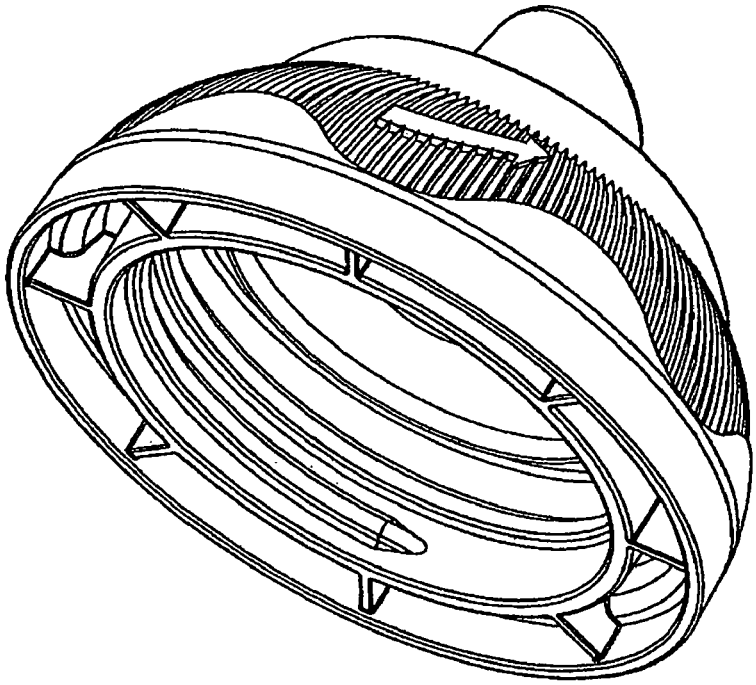
Figure 3:
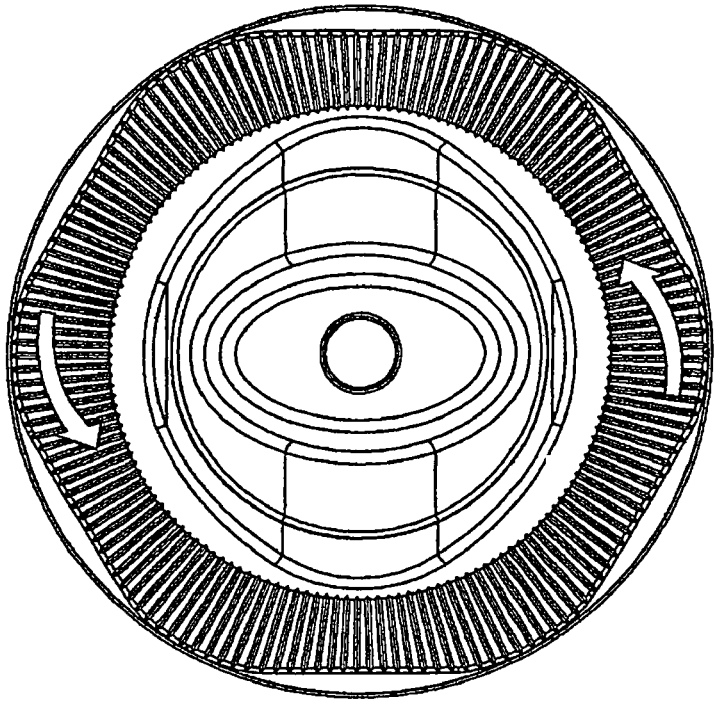
Figure 4:
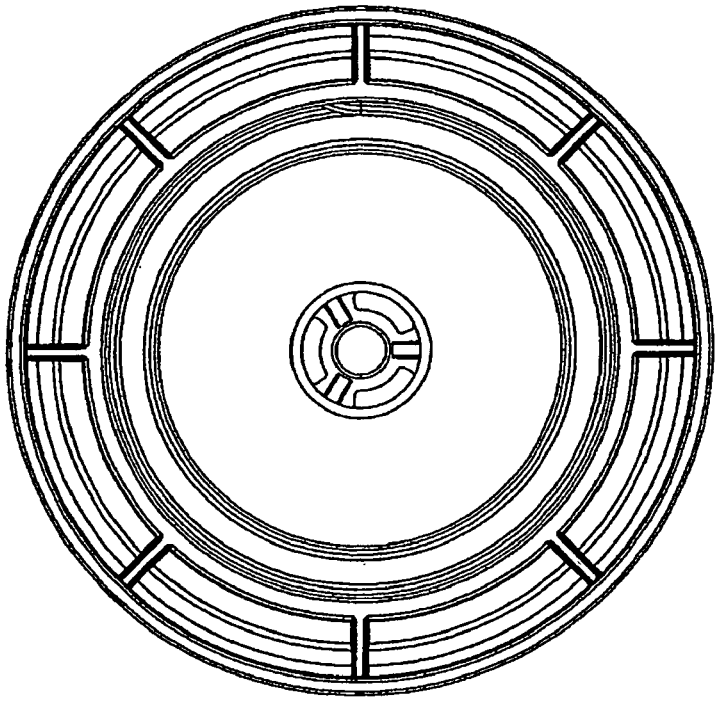
Figure 5:
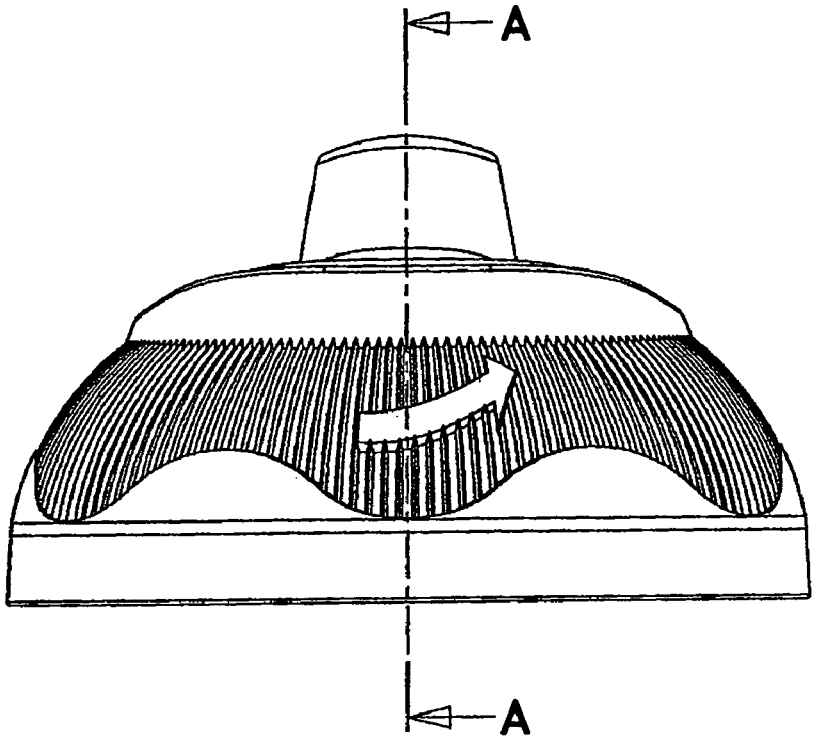
Figure 6:
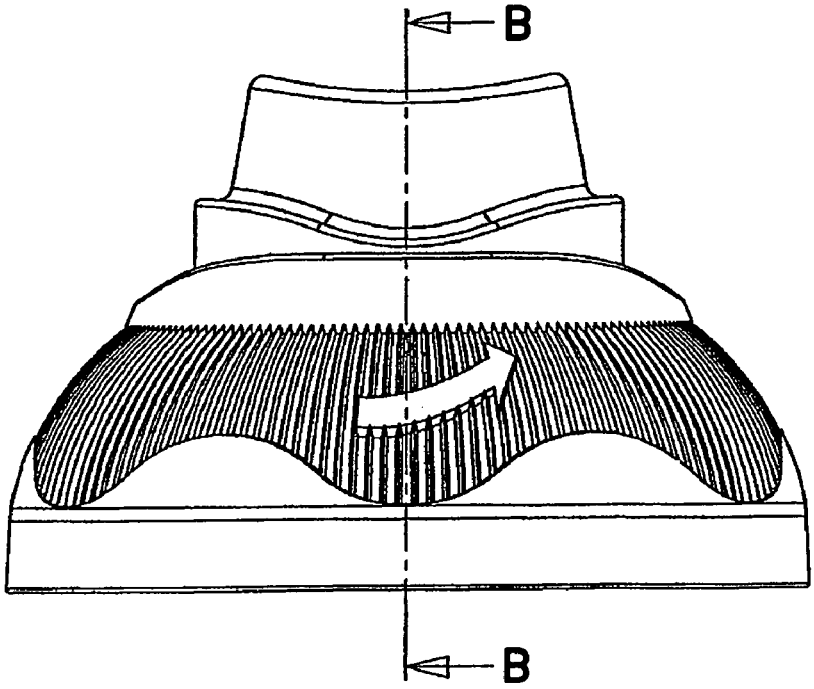

In the preferred forms of the present invention the components are moulded as single unitary items although in some other forms one or more of the components can be machined and/or fabricated in some way. That however detracts from the low cost prospect of a simplified jigged or robotic assembly of a closure structure capable of being removed as a whole from a screw threaded complementary container and/or being applied thereto.

In the case of sales of an empty container, the closure assembly would be attached to the assembly and can be removed for filling by rotation of the assembly as a whole or by obtaining a manual purchase on the peripheral region of the first component only. The options referred to previously also exist.

The other sales option of course is to provide a filled container preferably sealed with a foil or other such closure under an assembly of an embodiment of the present invention. An embodiment as shown in FIGS. 20 through 31 is more preferable for that although the arrangement as shown in FIGS. 32 through 60 can be modified by reconfiguring to ensure that a foil can be interposed between the first component and the mouth rim of an externally threaded container to achieve an hygienic seal under the inlet of the passageway to the outlet of the columnar structure of the first component.

Preferred plastics materials are to be used for each component. Possible plastics are selected from the group consisting of polypropylene (PP) and polyethylene (PE), Most preferably the first component or base is formed from PP, the second component or top is formed from HDPE and the twist ring or third component is formed from PP.

The embodiment of FIGS. 1 to 31 is an assemblage of the three components shown therein.

As can be seen there is a first component 1 (see FIG. 9) which has a periphery 2 available for manual grip or purchase for removal of that threaded component, if desired, when assembled. That thread 3 can best be seen in FIGS. 15 and 16.

Figure 7:
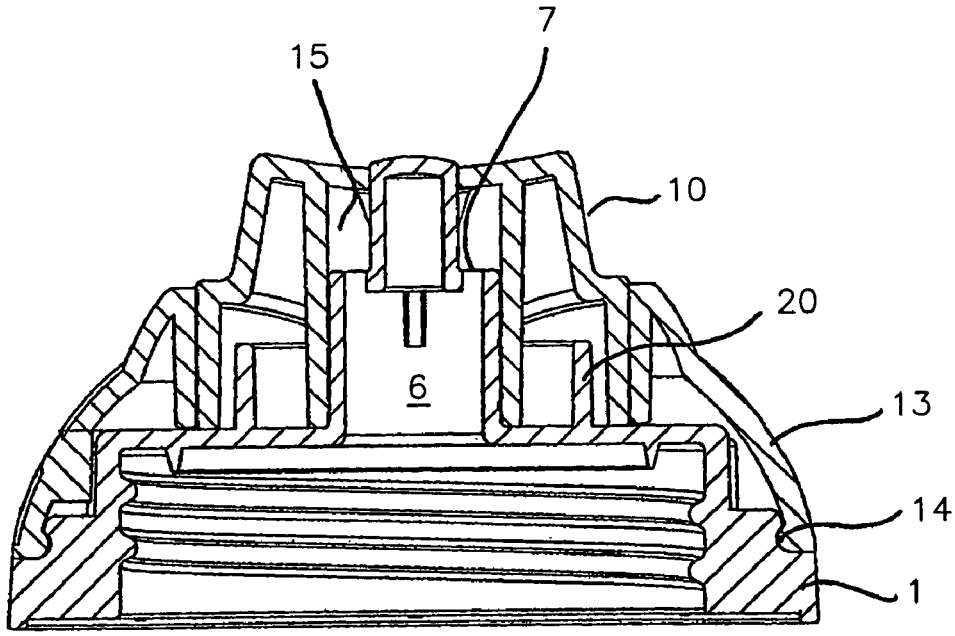

The columnar form 4 provides an entrance 5 for liquid from an engaged container and, via a passageway 6, out of an outlet 7 which is below the closure portion 8 which is, as shown in FIGS. 1 and 7, able to occlude the dispensing opening 9 of a second component or top 10. The top 10, apart from its spout type form, includes a thread or thread following formation 11 adapted to be engaged by the thread or thread follower 12 (see FIG. 25) of the third component or twist ring 13.

Figure 8:
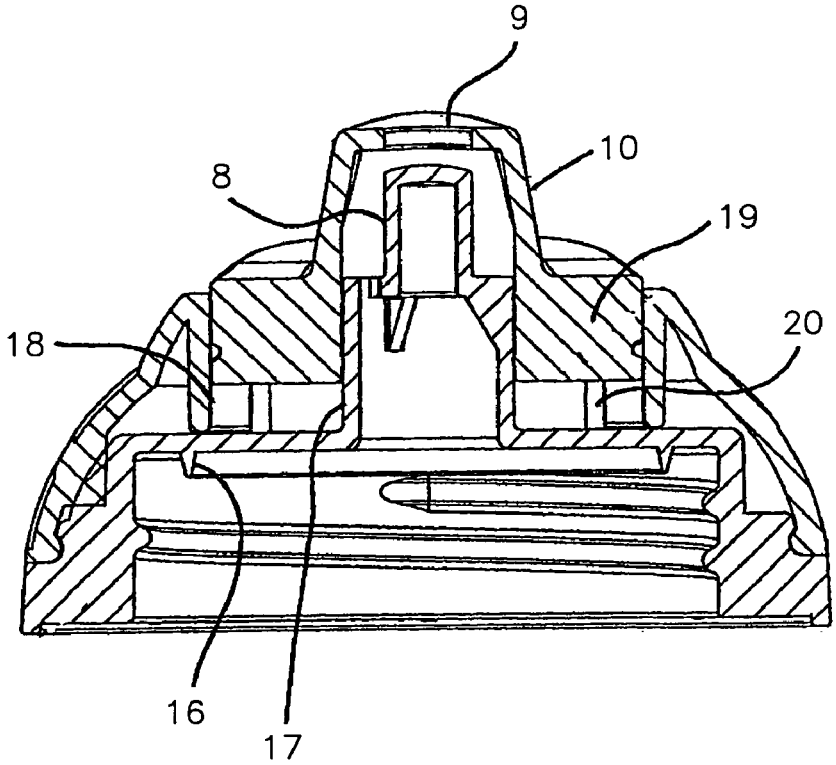
Figure 9:
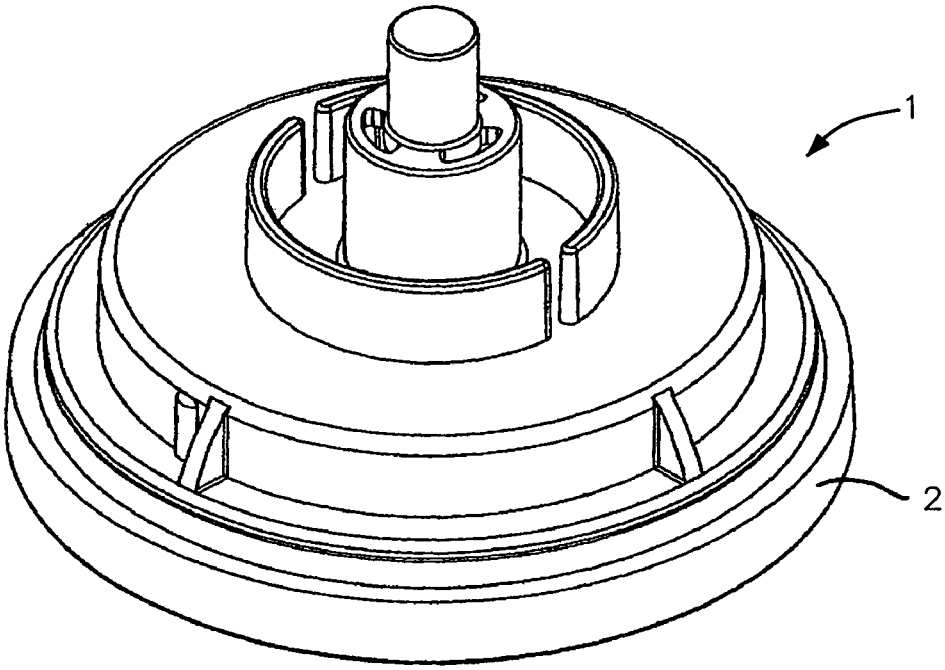
Figure 10:
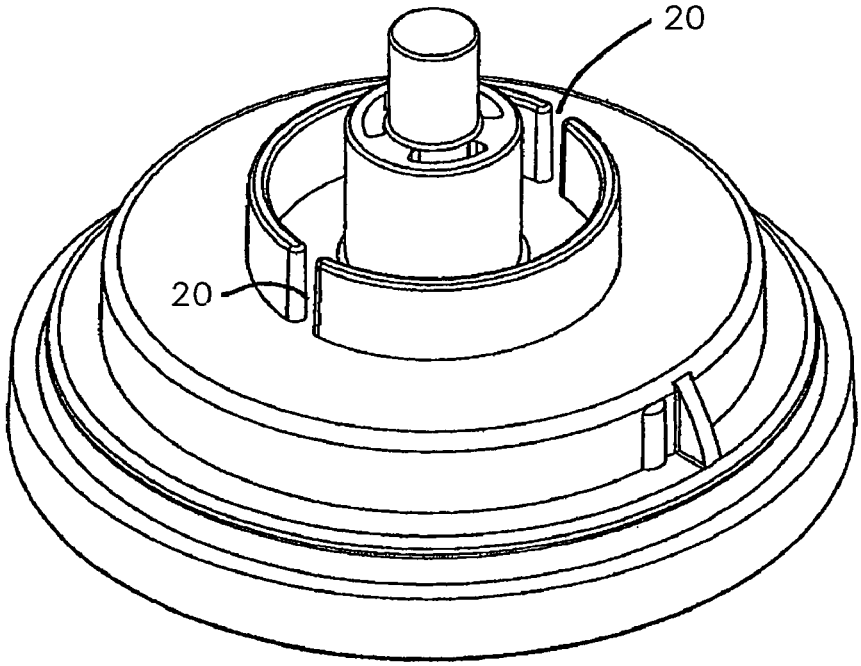
Figure 11:
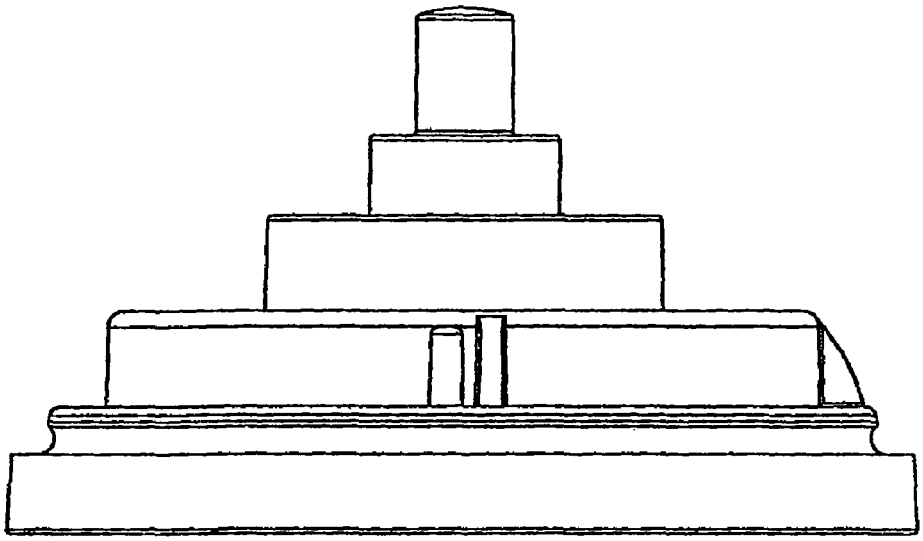
Figure 12:
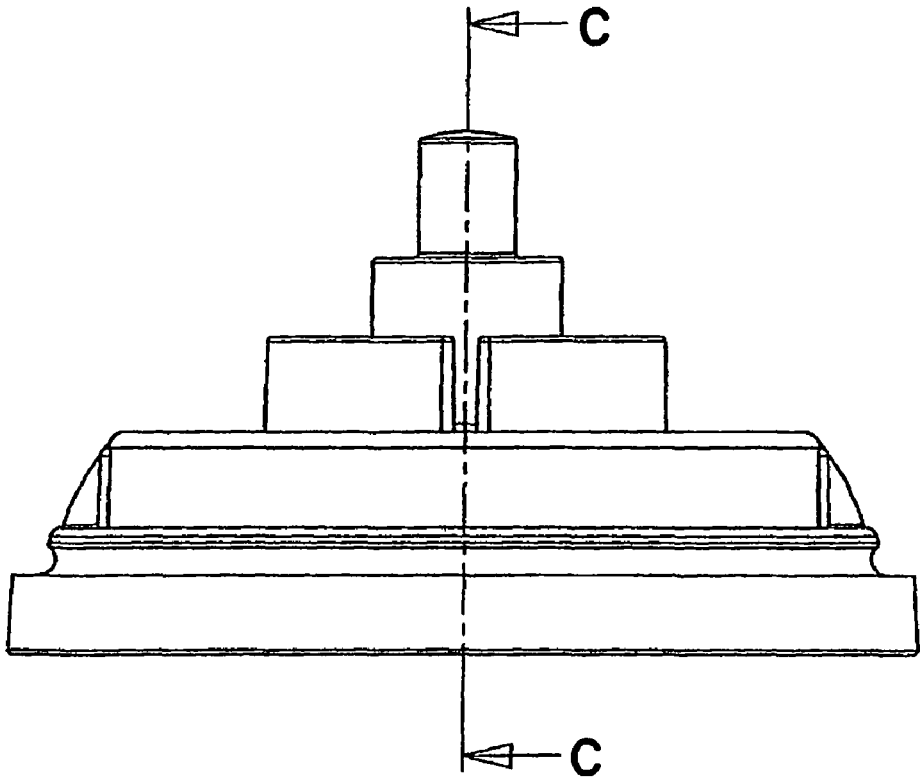
Figure 13:
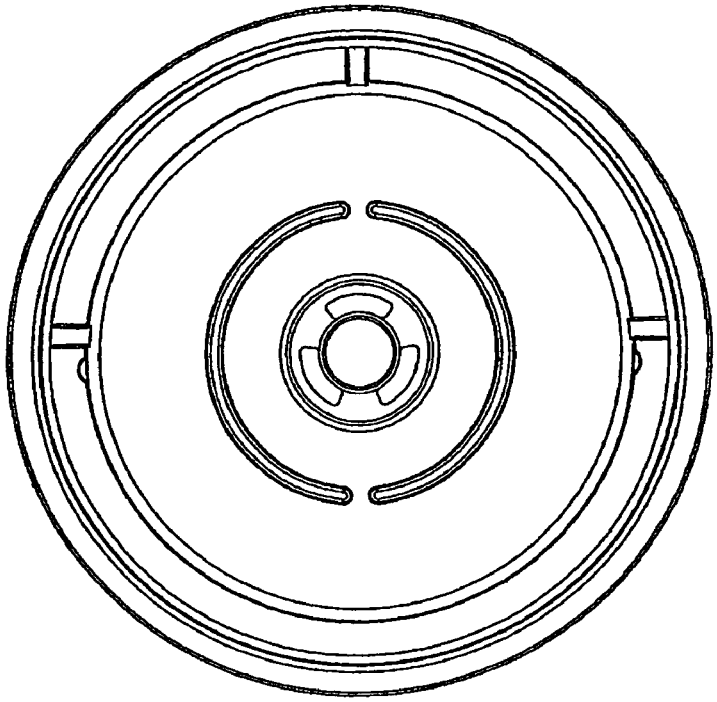
Figure 14:
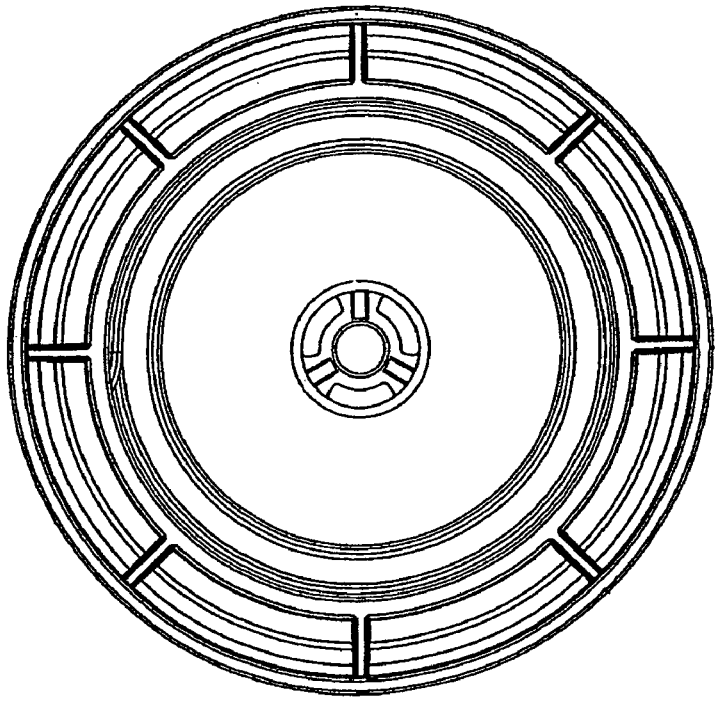
Figure 15:
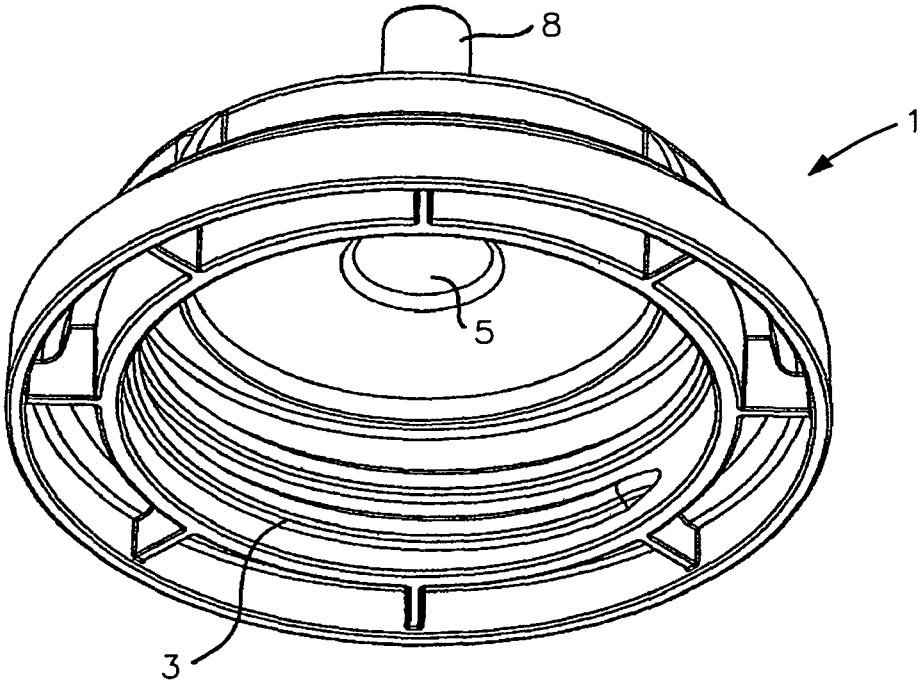
Figure 16:
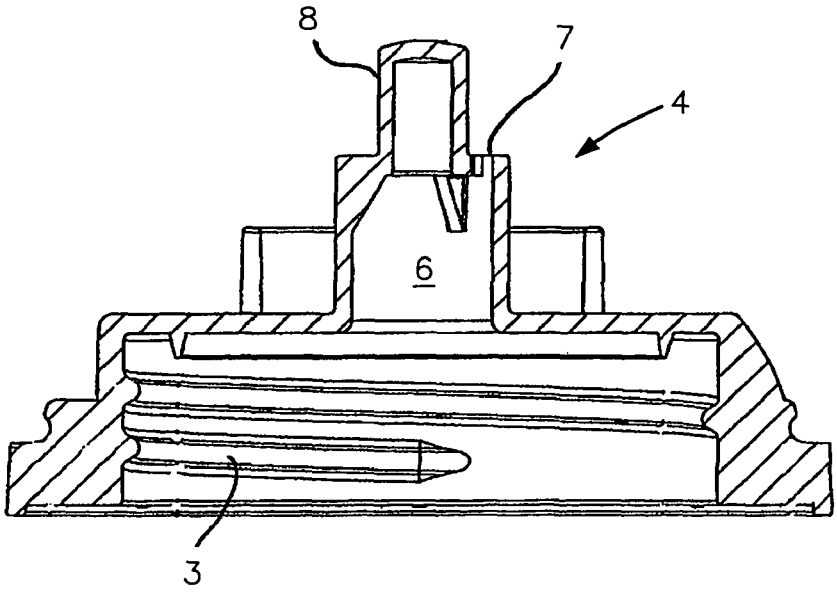
Figure 17:
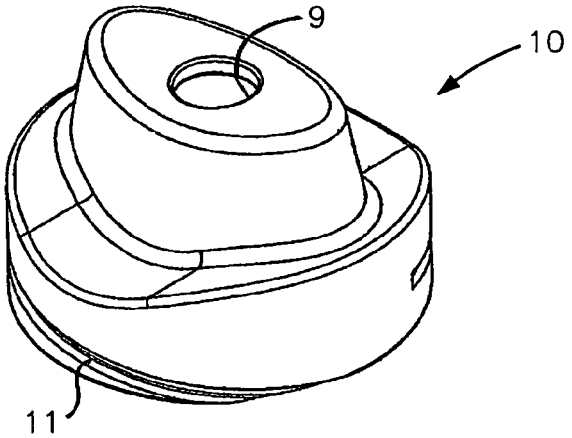
Figure 18:
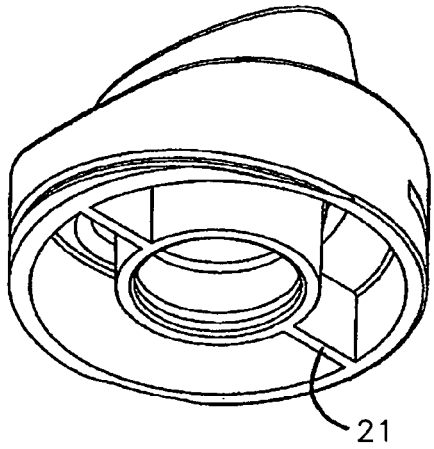
Figure 19:
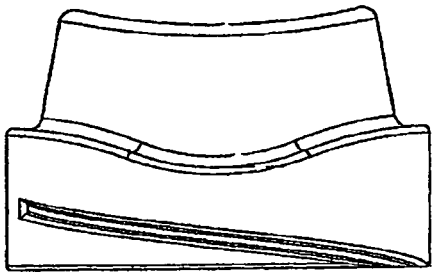
Figure 20:
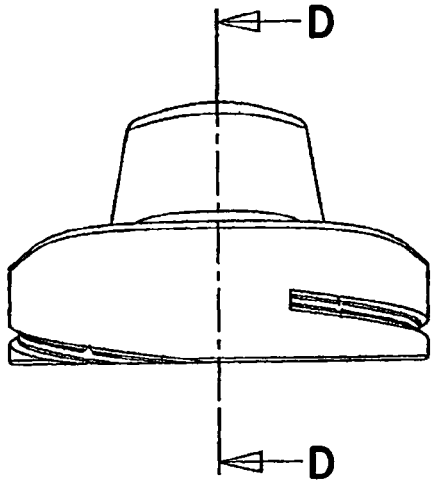
Figure 21:
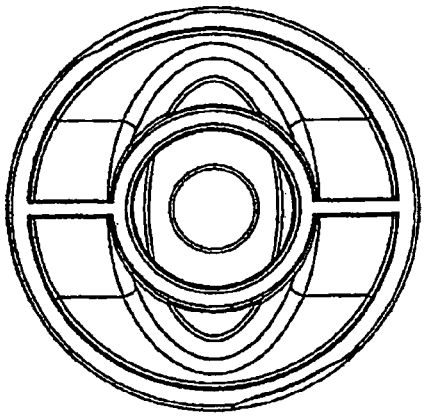
Figure 22:
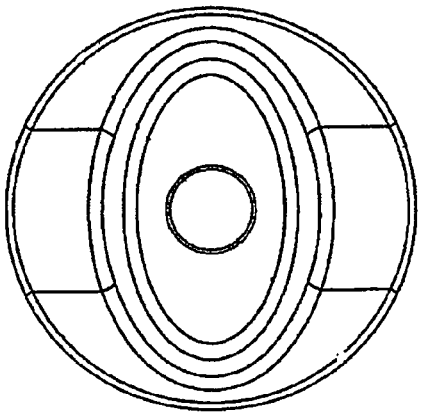
Figure 23:
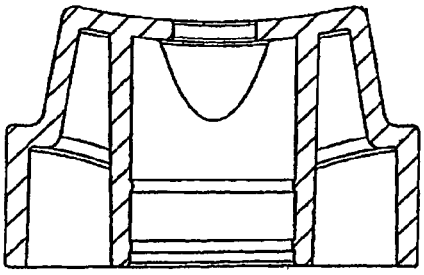
Figure 24:
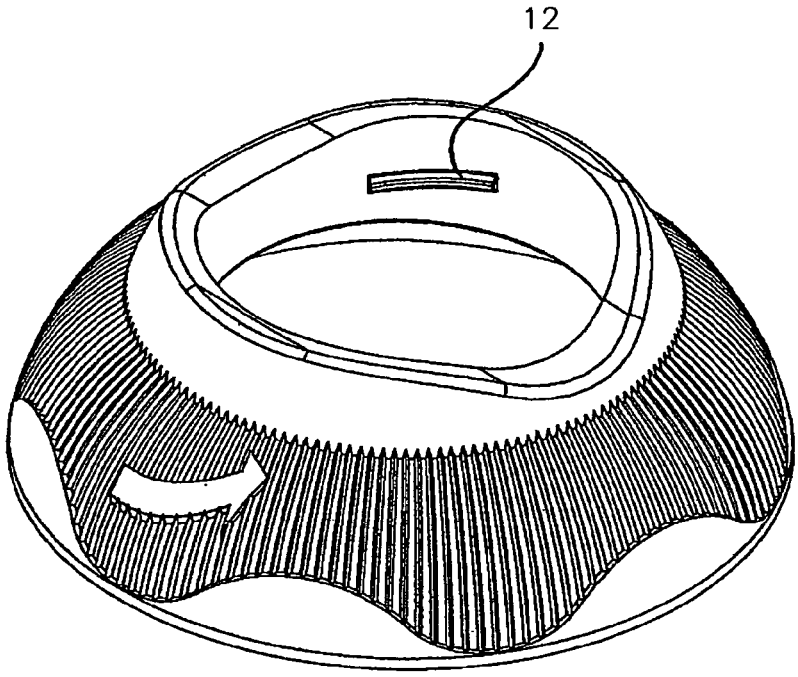
Figure 25:
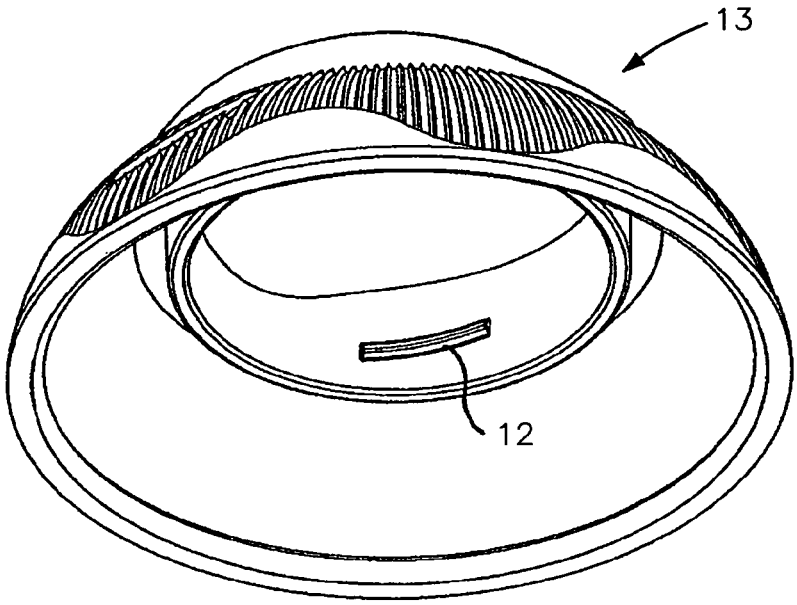
Figure 26:
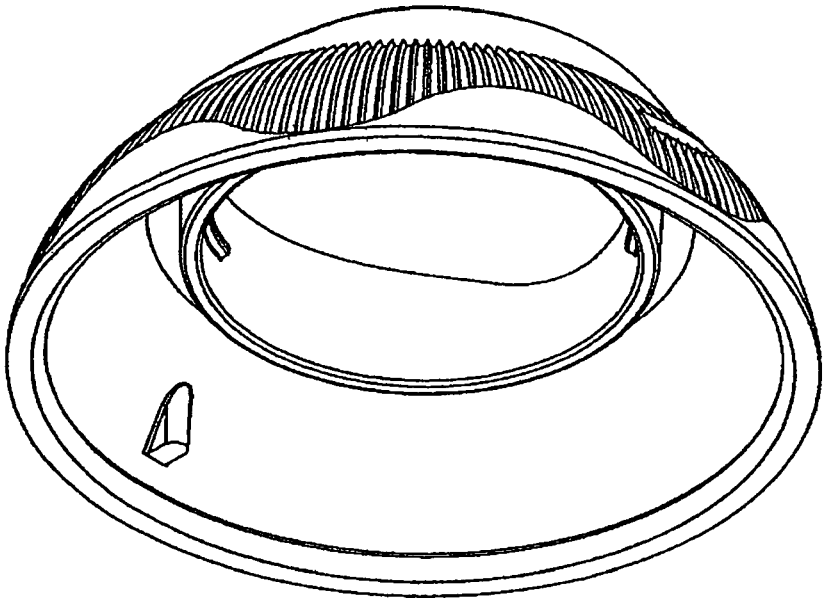
Figure 27:
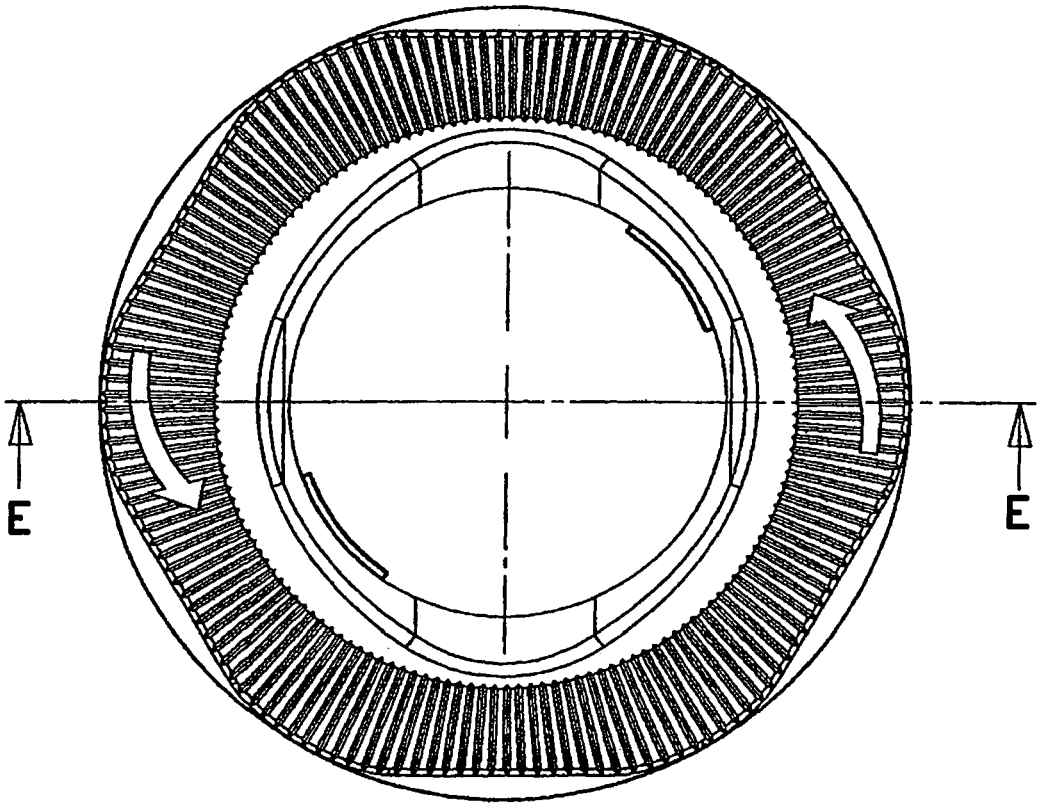
Figure 28:
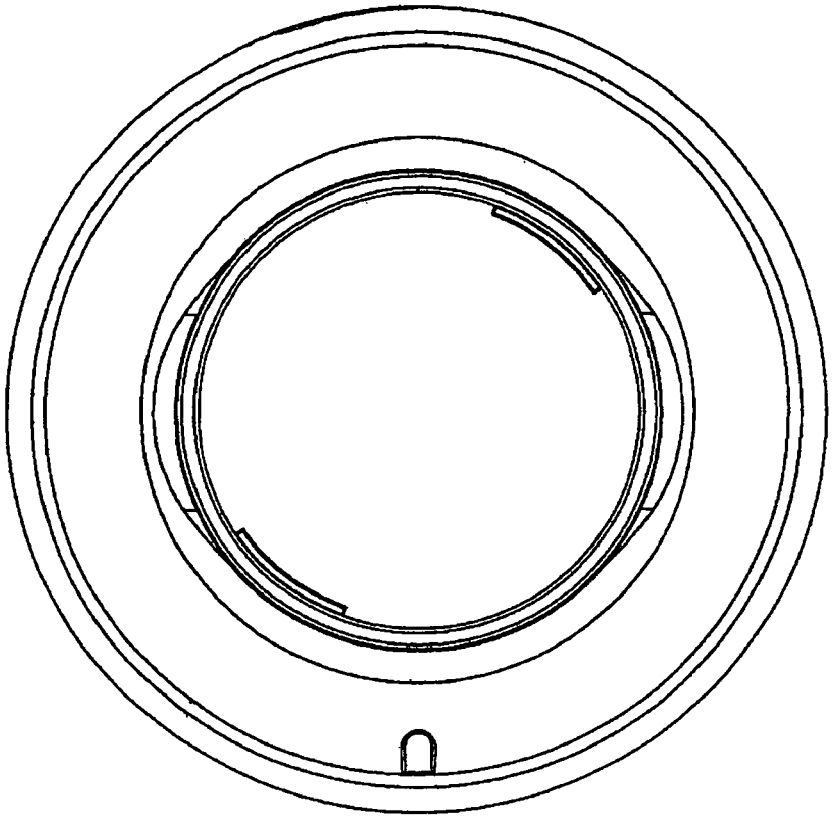
Figure 29:
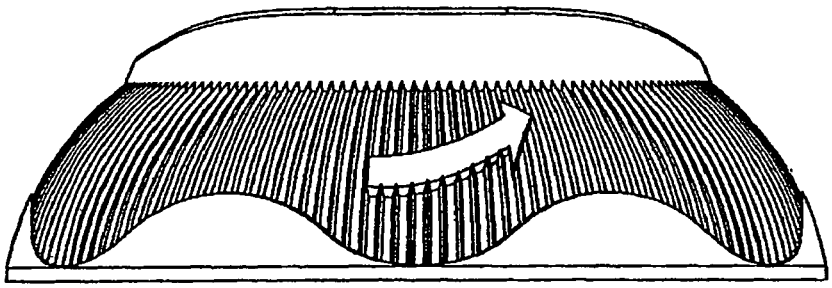
Figure 30:
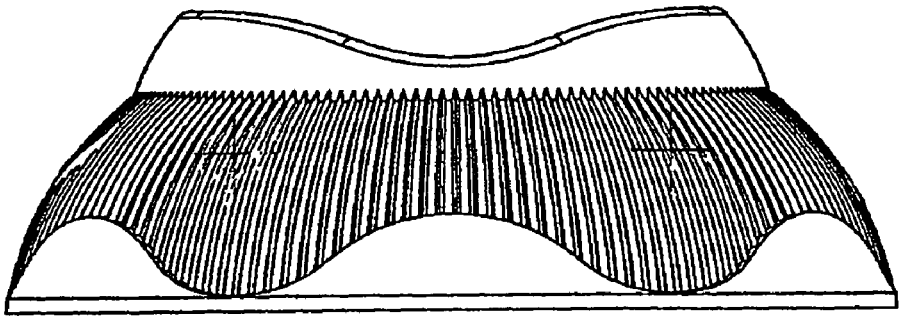
Figure 31:
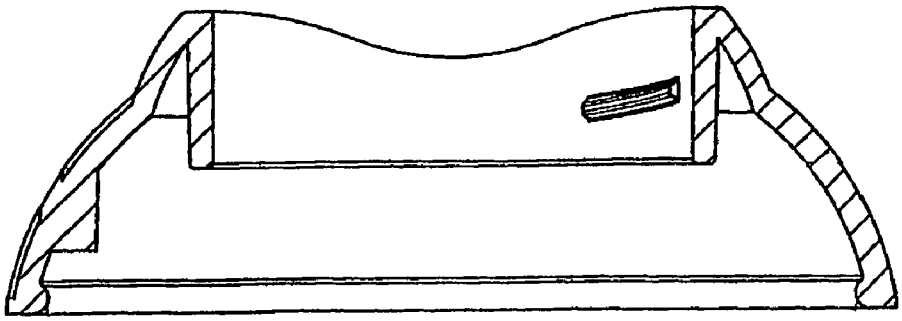
Figure 32:
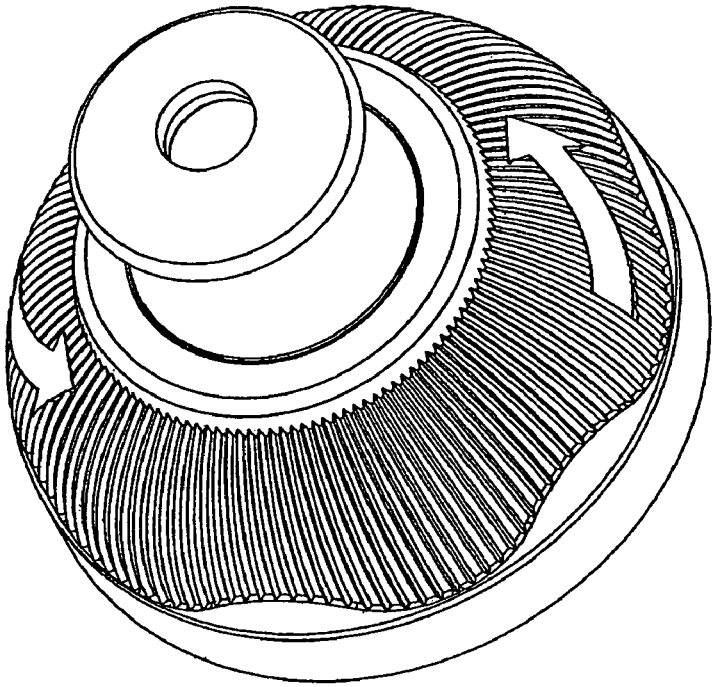
Figure 33:
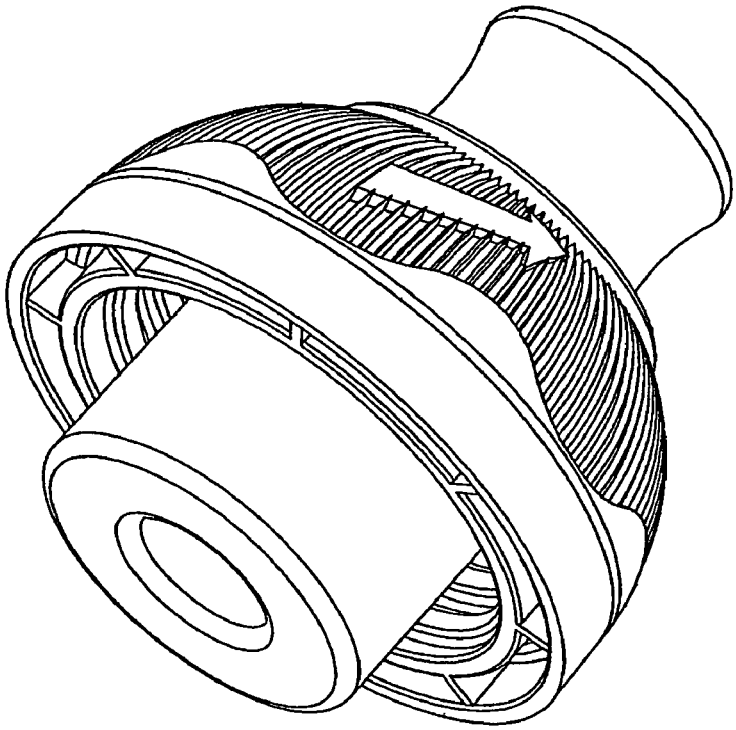
Figure 34:
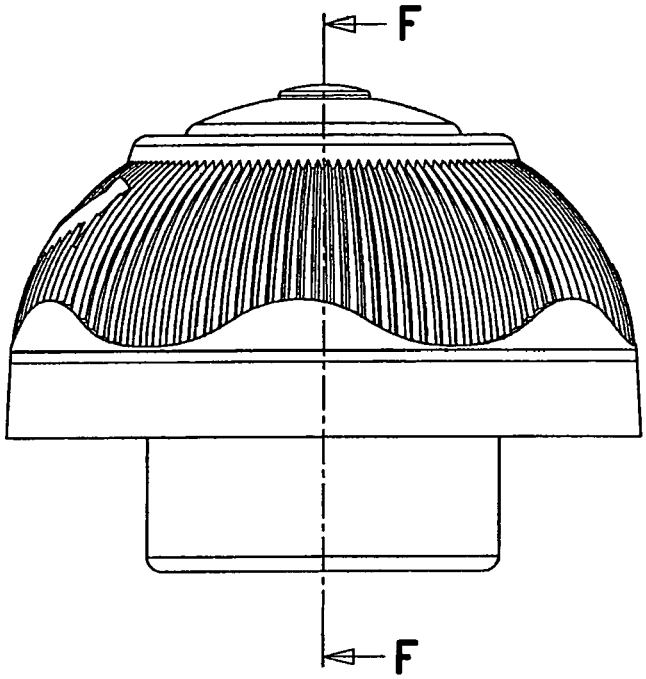
Figure 35:
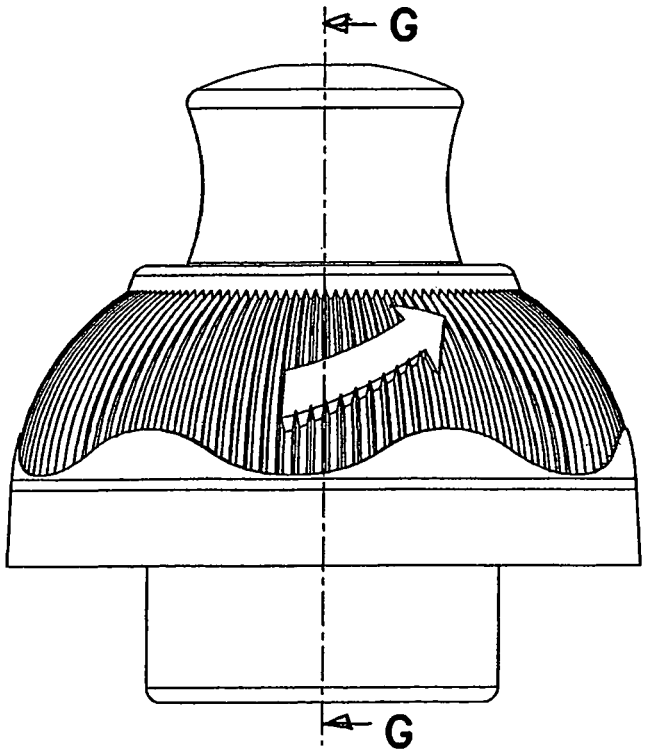
Figure 36:
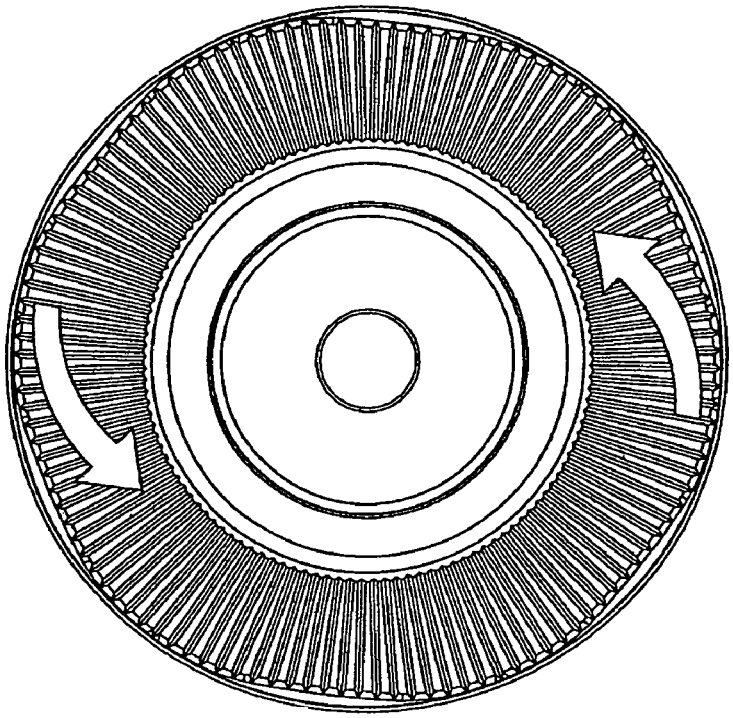
Figure 37:
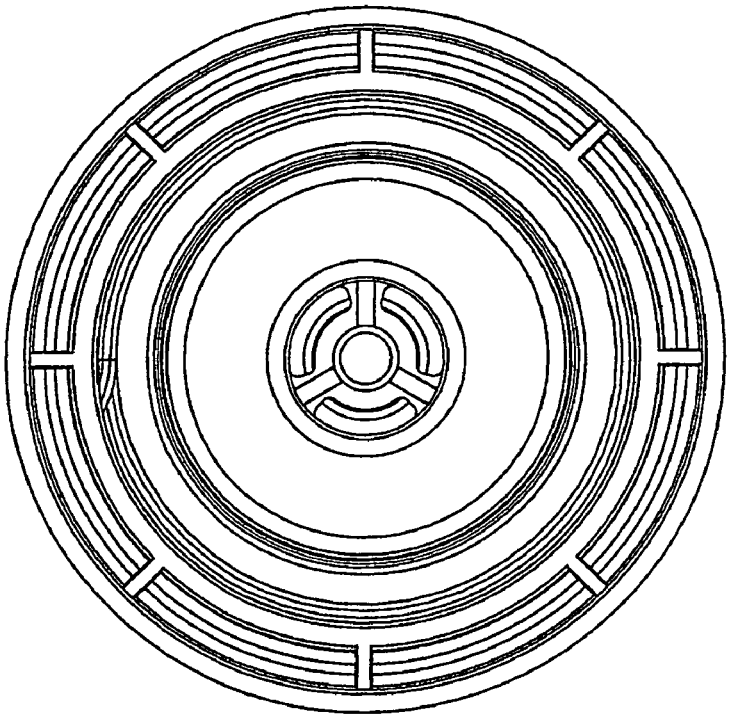
Figure 38:
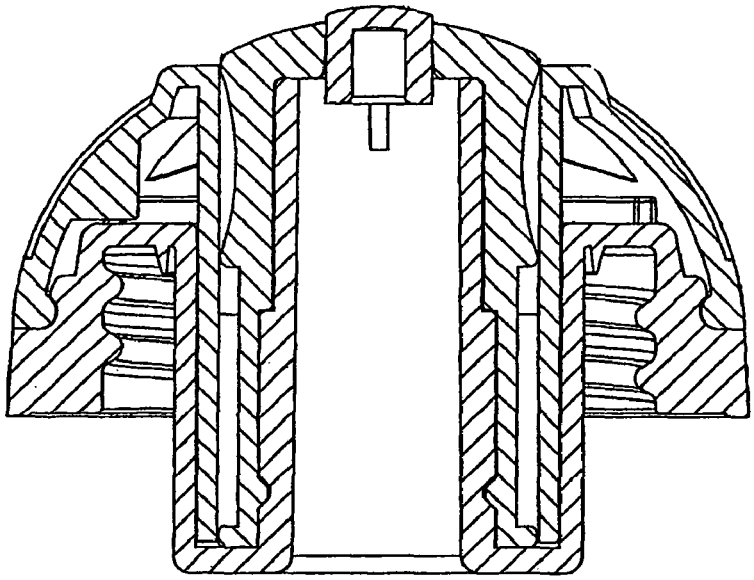
Figure 39:
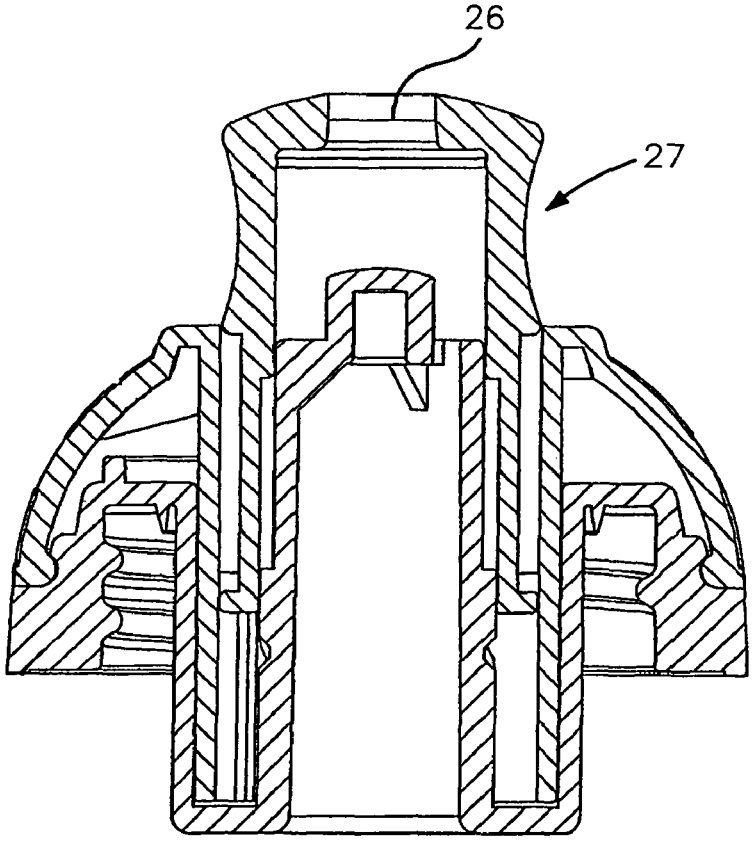
Figure 40:
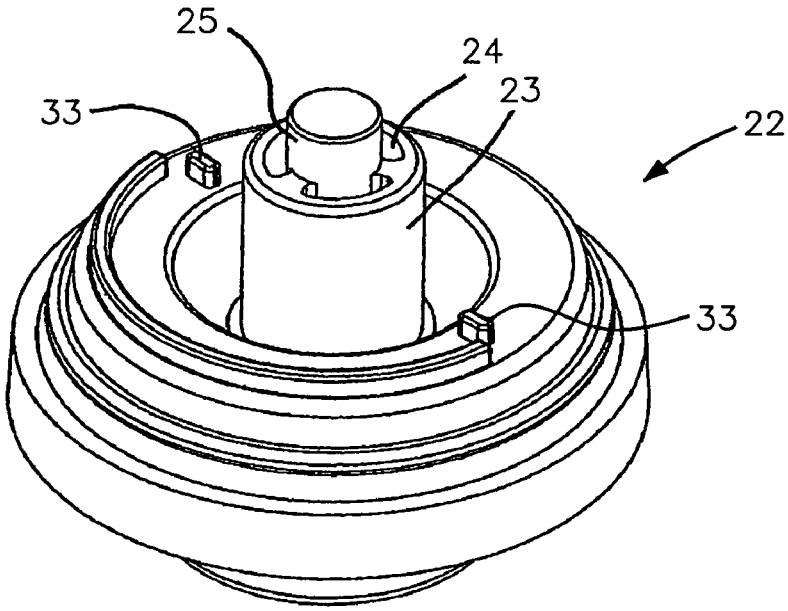
Figure 41:
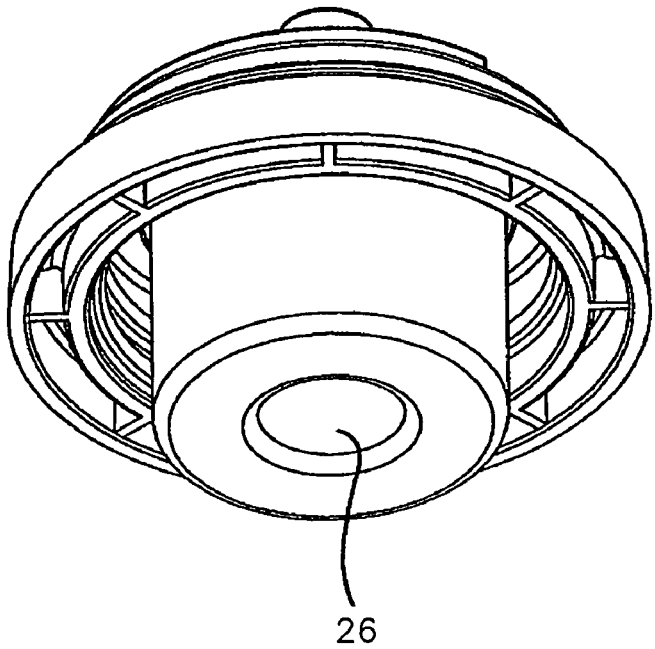
Figure 42:
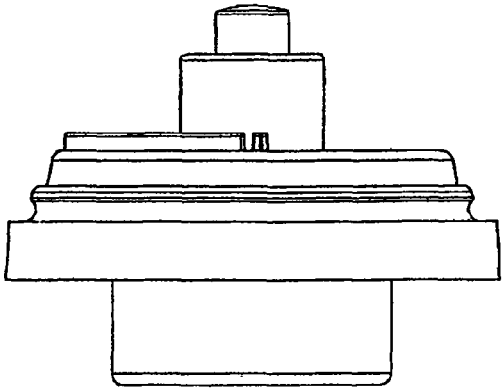
Figure 43:
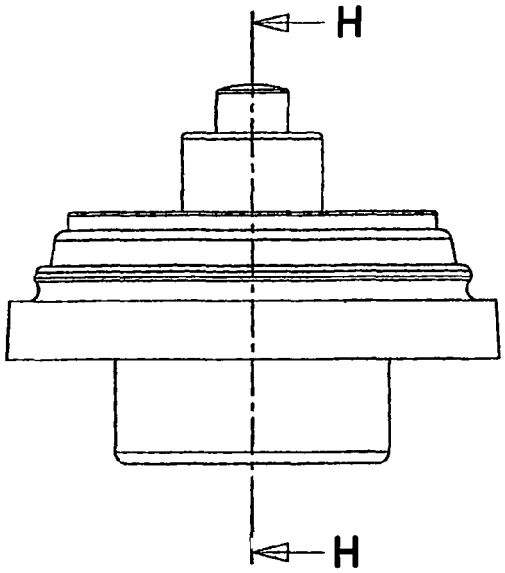
Figure 44:
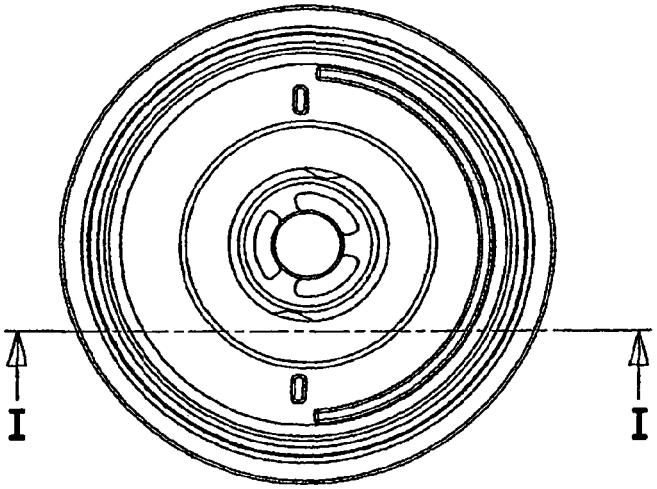
Figure 45:
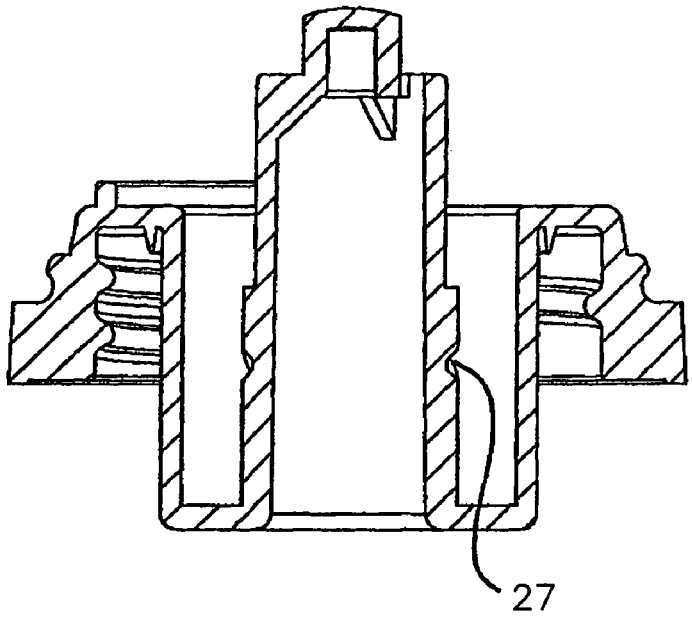
Figure 46:
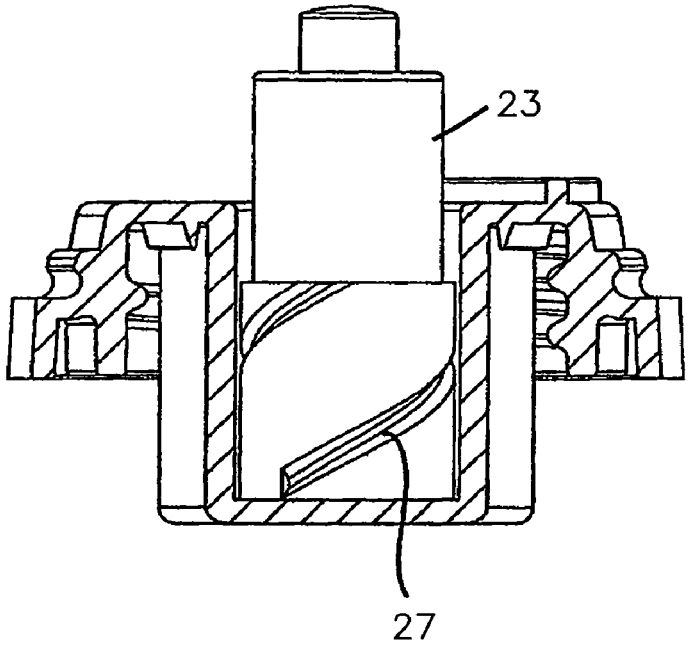
Figure 47:
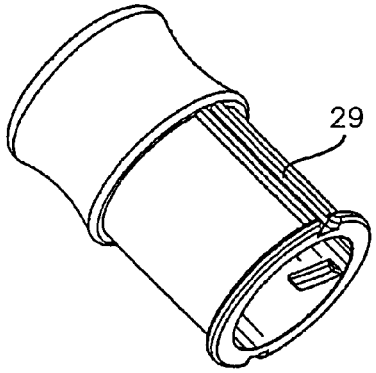
Figure 48:
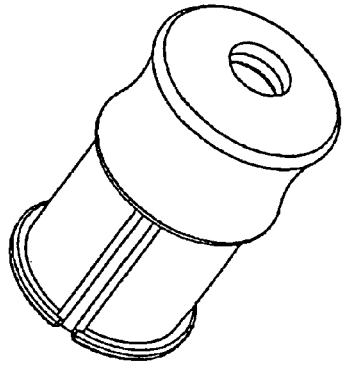
Figure 49:
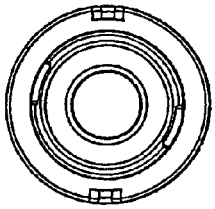
Figure 50:
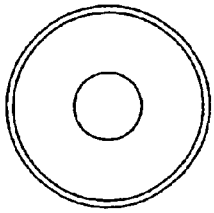
Figure 53:
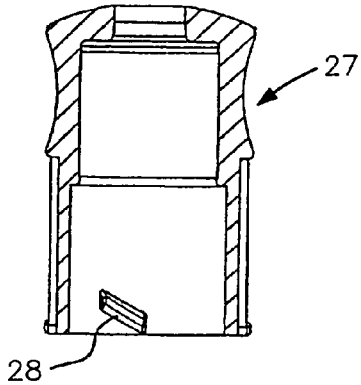
Figure 51:
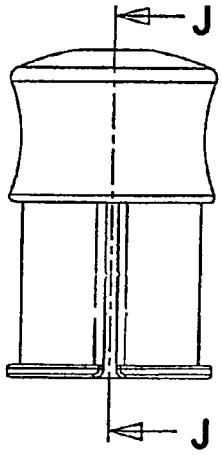
Figure 52:
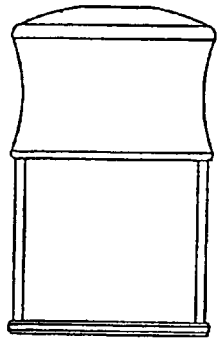
Figure 54:
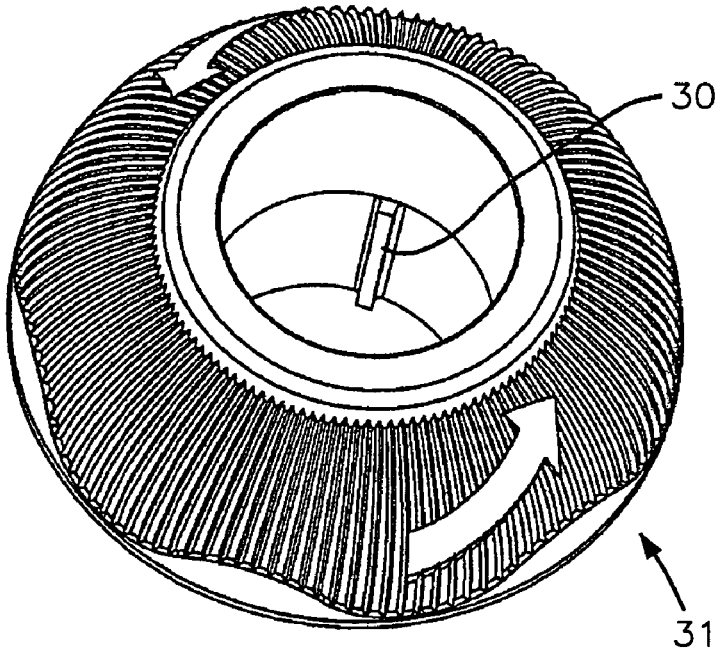
Figure 55:
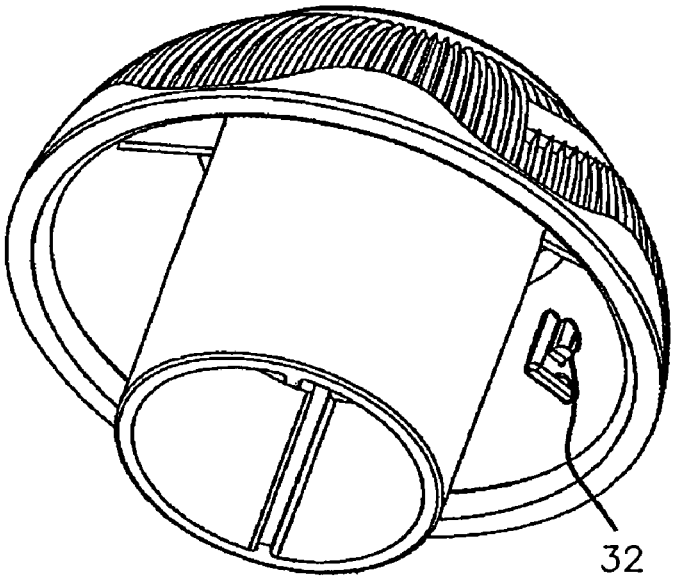
Figure 56:
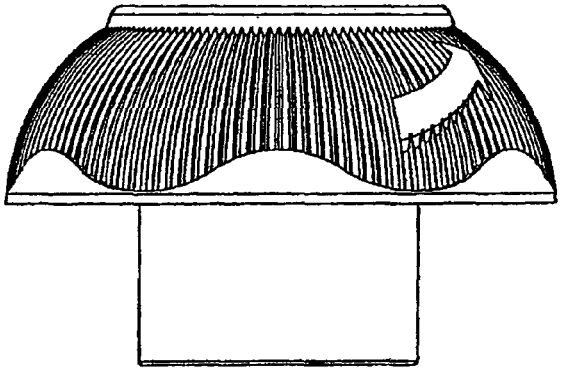
Figure 57:
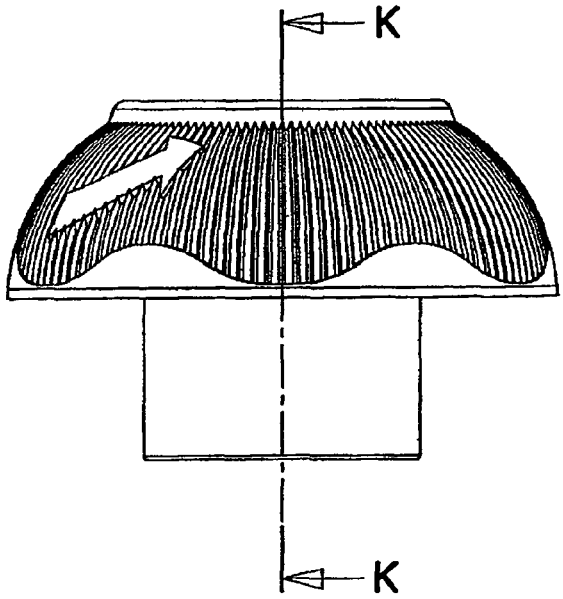
Figure 58:
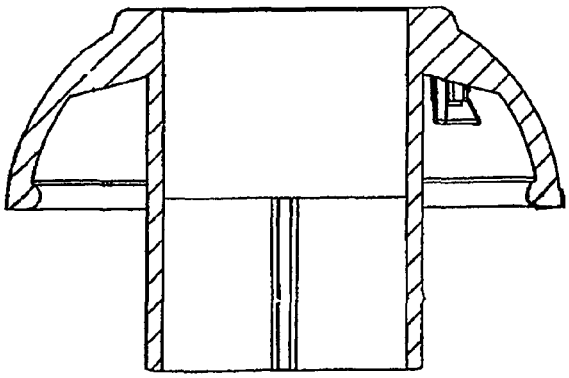
Figure 59:
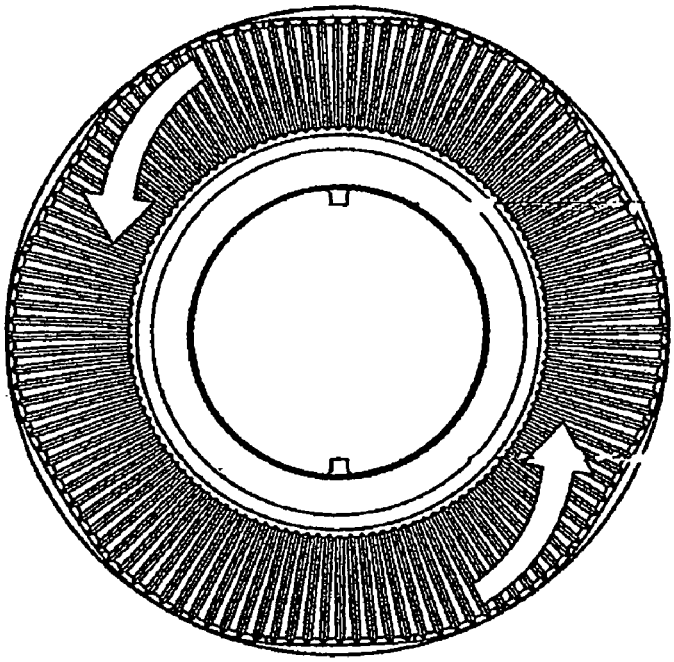
Figure 60:
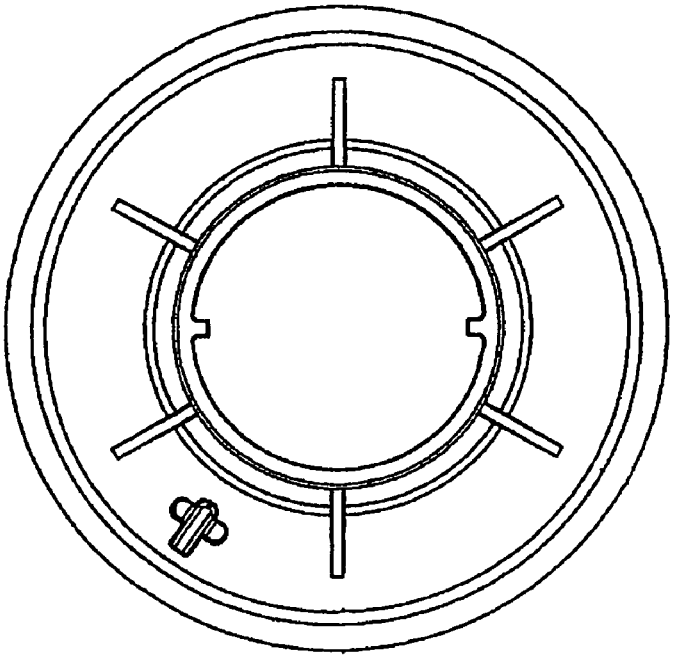
Figure 61:
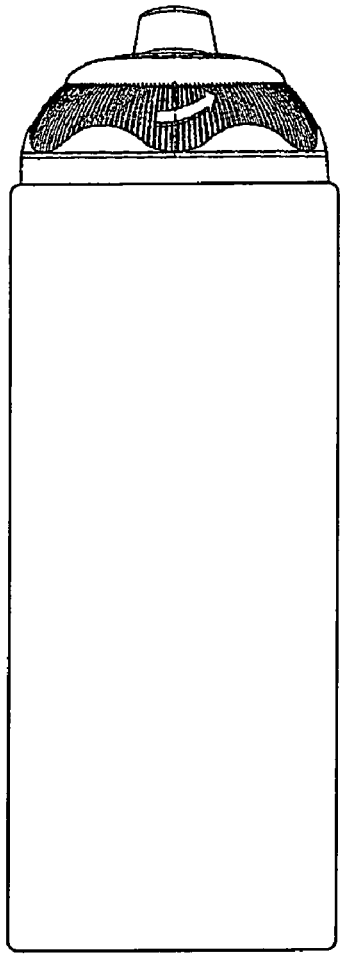
FIG. 61 shows an assembly of the embodiment of FIGS. 1 through 31 atop a notional container.
Figure 62:
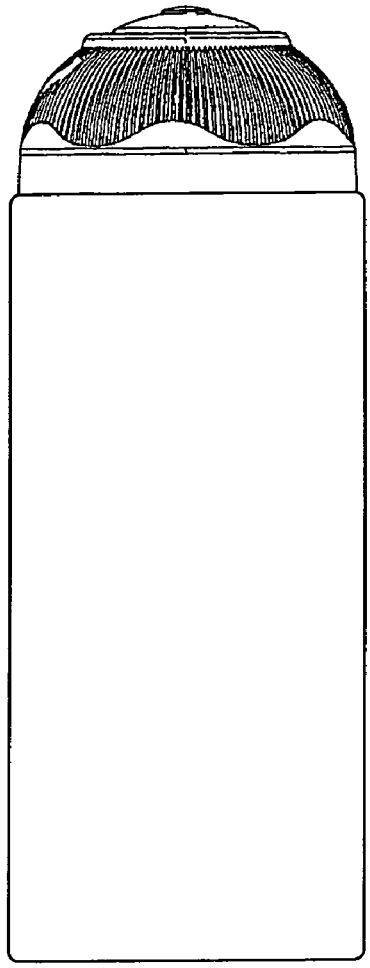
FIG. 62 shows an assembly of the embodiment of FIGS. 32 through 60 on the top of a notional container.

As shown the component 10 (the top) can move between the conditions shown in the cross sections of FIGS. 7 and 8 under the rotational action of the captive twist ring 13 held captive to the first component 1 by a clip fit bead into groove engagement at 14 (see FIG. 7).

As best can be seen from the cross sections of FIGS. 7 and 8 whilst liquids can enter the passageway 6, pass via the outlet 7 into the chamber 15, other liquid movement is prevented and the liquid cannot exit the opening 9 owing to that being occluded, by the closure portion 8.

Other features include the provision of sealing rings 16 in the first component 1, and an arrangement whereby the surface 17 of the first component 1 and the surface 18 of the twist ring seals in a substantially fluid type manner against the region 19 of the second component.

Provision can be made for restricting the amount of rotation required for an opening and/or closure cycle and indeed some bump engagement can be provided to that end.

Another feature of interest is the provision of gaps 20 in the wall of the first component into which members 21 of the second component (see FIG. 18) are slidable so as to be restricted against relative motion with respect to the first component so that the affect of the thread inter-engagement with the twist ring is an axial raising and lowering as depicted in the drawings rather than any other movement.

The embodiment of FIGS. 32 through 60 is different but is of the same three essential components and preferably after clip fitting of the third member to the first member, it can be handled as a unit. Here the arrangement involves a first member 22 with its columnar upstand 23 about an open passage 26 having its outlet or outlets 24 preferably below a closure portion 25 which is to occlude the dispensing opening 26 of the second component or top. As can be seen by reference to FIG. 46 the columnar structure or form 23 includes a thread or thread following arrangement 27. This thread arrangement is to engage the thread or thread follower 28 shown in the component 27 (see FIG. 53). The component 27 is held against rotation by its key ways or grooves 29 riding on a complementary form 30 (see FIG. 54) of the twist ring 31. These anti-rotation guideways and guide followers can be plural and can differ i.e male to female and female to male to ensure proper location.

Shown also in the component 31 (see FIG. 55) is a formation 32 the function of which is to abut the upstands 33 of the first component (see FIG. 40) thereby to restrict twisting movement between the open and closed conditions to about 180°. Such an arrangement however is not mandatory.

Persons skilled in the art will appreciate how the embodiments depicted have been provided with a bump to stop feature on opening and a bump to stop feature on closing. In each case the bump provides a measure of hold against a change of condition until the bump is overwhelmed by a reverse rotation of the third component.

The invention claimed is:

1. A dispensing closure assembly suitable to be engaged to a complementary container, said assembly comprising a first moulded component adapted to engage an outlet of a complementary container and to provide a single inlet of said first moulded component above said container through a flat plate of a sealing ring for sealing a top of the container from which any liquid content of said container can only egress, the first moulded component including a closure portion above an outlet, a second moulded component about part of said first moulded component and having a dispensing outlet capable of being closed by the closure portion of said first moulded component, the first and second moulded components having coacting features below the outlet of the first moulded component to restrict relative movement between the first and second moulded components at least substantially to a rectilinear vertical or at least substantially non rotational movement of one relative the other, a third moulded component held captive by said first moulded component but rotatable relative thereto, and being threadedly associated with the second moulded component so that rotation of the third moulded component causes by a vertical straight lowering of the second moulded component relative to the first moulded component, and vice versa, closing, and opening respectively, of the outlet of the second moulded component, limits provided by abutment between features of the first and third moulded components to restrict an amount of rotation of the third moulded component relative to the first moulded component.

2. An assembly of claim 1, wherein the first moulded component defines an internally threaded region adapted to engage a complementary thread of the complementary container.

3. An assembly of claim 2, wherein said internally threaded region is integral with a region defining a passageway and/or closure portion.

4. An assembly of claim 2, wherein the second moulded component has an external thread or thread followers to complement an internal thread or thread follower of said third moulded component.

5. A dispensing closure assembly suitable to be engaged to a complementary container, said assembly comprising a first component or assembly adapted to engage an outlet of a complementary container and to provide a single inlet of the first component located above the container through a flat plate of a sealing ring for sealing a top of the container from which any liquid content of the container can only egress, the first component including a closure portion, a second component or assembly about part of said first component and having a dispensing outlet of the second component capable of being closed by the closure portion of said first component, the first and second components having coacting features below the outlet of the first component to restrict relative movement of the first and second components to a lowering of the second component and a rising of the second component to effect closure and opening, respectively, of the dispensing outlet of the second component, a third component or assembly held captive by said first component but rotatable relative thereto, and being interengaged with the second component so that rotation of the third component causes the closing and the opening of the dispensing outlet of the second component by the closure portion of the first component.

* * * * *